US005474361A

United States Patent [19]

Hwang et al.

[11] Patent Number: 5,474,361

[45] Date of Patent: Dec. 12, 1995

[54] PORTABLE CHAIR STRUCTURE

[76] Inventors: Phillip Hwang; Lisa Hwang, both of Rm. 6A, No. 261, Nanking East Rd., Sec. 3, Taipei, Taiwan

[21] Appl. No.: 285,205

[22] Filed: Aug. 3, 1994

[51] Int. Cl.[6] ..... B60N 2/02

[52] U.S. Cl. ..... 297/380; 297/452.41; 5/633; 5/654

[58] Field of Search ..... 297/380, 381, 297/382, 452.41, 452, 488, 228.1, 229; 5/633, 653, 654, 465

[56] References Cited

U.S. PATENT DOCUMENTS

| | | | |
|---|---|---|---|
| 3,112,956 | 12/1963 | Schick et al. | 297/382 |
| 3,140,897 | 7/1964 | Dougherty | 5/465 X |
| 4,396,227 | 8/1988 | Neilson | 297/229 |
| 4,824,171 | 4/1989 | Hollingsworth | 297/380 |
| 5,100,203 | 3/1992 | Novak | 297/380 |
| 5,190,350 | 3/1993 | Hwang et al. . | |
| 5,265,933 | 11/1993 | Croshaw | 297/228.1 |

*Primary Examiner*—Kenneth J. Dorner
*Assistant Examiner*—Anthony D. Barfield
*Attorney, Agent, or Firm*—Bacon & Thomas

[57] ABSTRACT

The present invention relates to a portable chair structure, and particularly to a chair structure that when folded down is space-saving and easy for carrying for leisure activities, comprising air cushion body, seat cover, and support rods wherein said air cushion body composed of a plurality of air cushions joined together, and on the top end of each air cushion having an intake for filling or discharge of air in or out of air cushion; on each end of seat cover having an awning for air cushion body to set therein, and each side of seat cover having support rod that provides support function to make the user of the chair feel more comfortable, and on each side of awnings having a connection strip connected to connection device, and the angle between the seat back and seat cover of chair can be adjustable by means of adjusting buckles on connection device.

2 Claims, 3 Drawing Sheets

PORTABLE CHAIR STRUCTURE

BACKGROUND OF THE INVENTION

The present invention relates to a portable chair structure, and particularly to a portable chair structure that is convenient for people climibing mountain or camping, mainly consisted of air cushion body, seat coverand support; when collapsed the gas in air cushion body can be discharged to enable it to be rolled up around the support as the shaft to become very small in dimension in facility of carrying.

As regard to the conventional portable chairs in general, they can not meet real need of consumers due to excessive dimensions after folded down and lacking of seat back; further because of materials for production they are too heavy to fail meet the user's requirement of convenience that has caused inconvenience and trouble of use for consumers.

SUMMARY OF THE INVENTION

One object of the present invention is to provide a convenient and space-saving chair for people climbing mountain or camping, and particularly to a chair including air cushion and upon filling air in air cushion it can be turned to become a chair with seat coverand back.

Another object of the present invention is to provide a chair that when fully exploded can become a sleep cushion and that when air fully squeezed out of air cushion body can be rolled up in facility of carrying in space-saving manner.

These and other objects and advantages of the present invention will become apparent to those skilled in the art after considering the following detailed specification together with the accompanying drawings.

DETAILED DESCRIPTION OF PREFERRED EMBODIMENT

Figure 1:
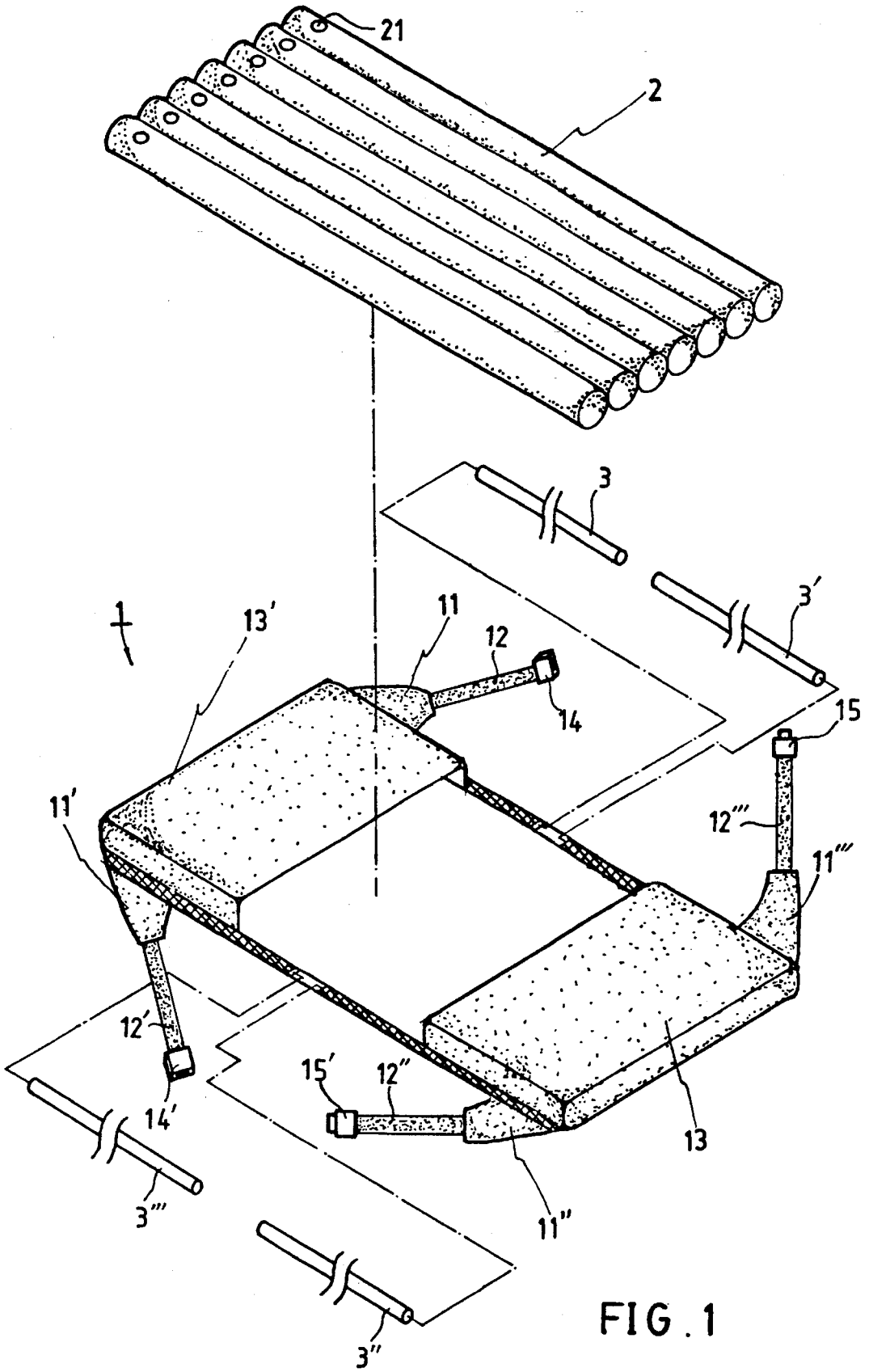
FIG 1 is a sectional view of the present invention.

Referring to FIG. 1, seat cover 1 is a long cloth cover, and each end of said seat cover 1 has awning 13 or 13' that may permit air cushion body 2 for setting therein, and each side of upper and lower awnings 13, 13' may include four support rods 3, 3', 3", 3''' which can enable to turn air cushion body 2 set in awnings 13, 13' of seat cover 1 to become a chair and to erect the chair with seat back.

Said air cushion body 2 is composed of a plurality of air cushions and on upper side of each air cushion has an intake

21 for filling or discharge of air in or out of air cushion body 2; upon discharge of air out of air cushion body 2 said chair can be rolled up along the support rods 3, 3', 3", 3''' beside the seat cover 1 as the shaft.

Figure 2:
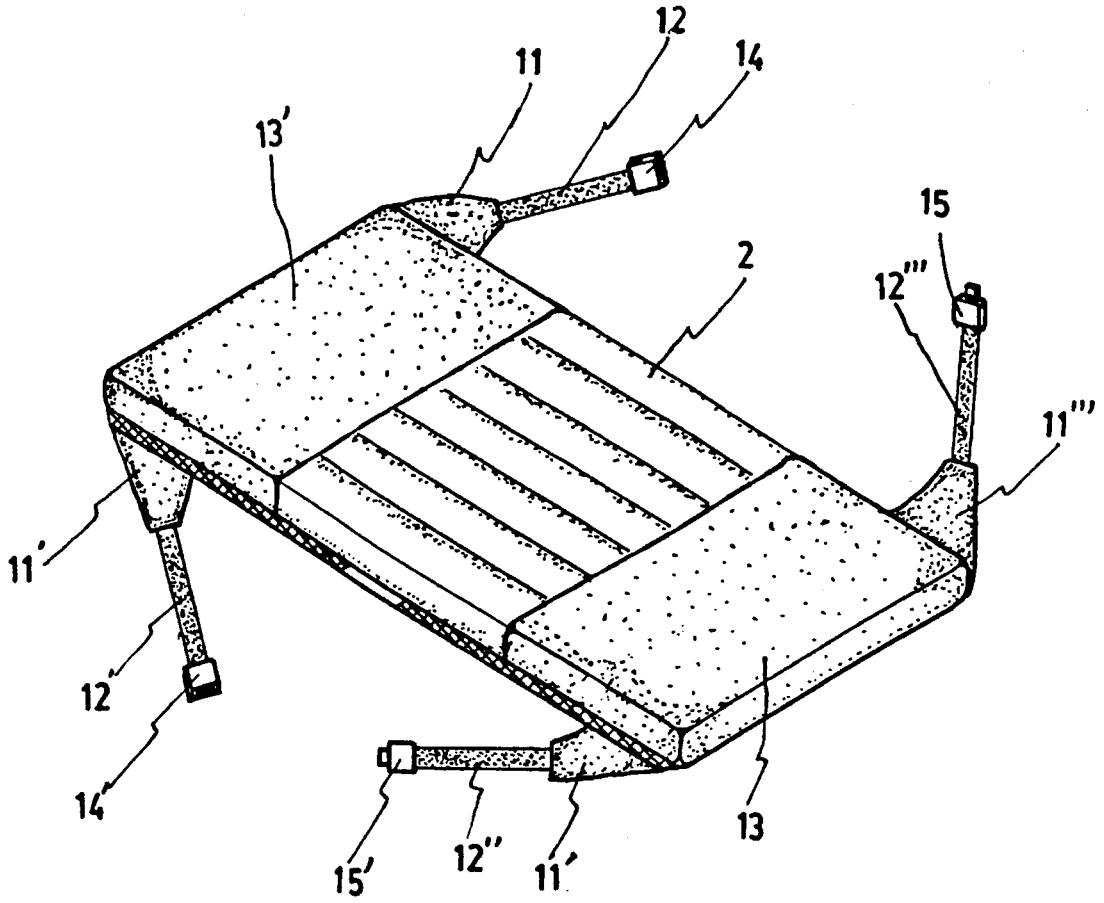
FIG. 2 is an exploded view of the present invention.
Figure 3:
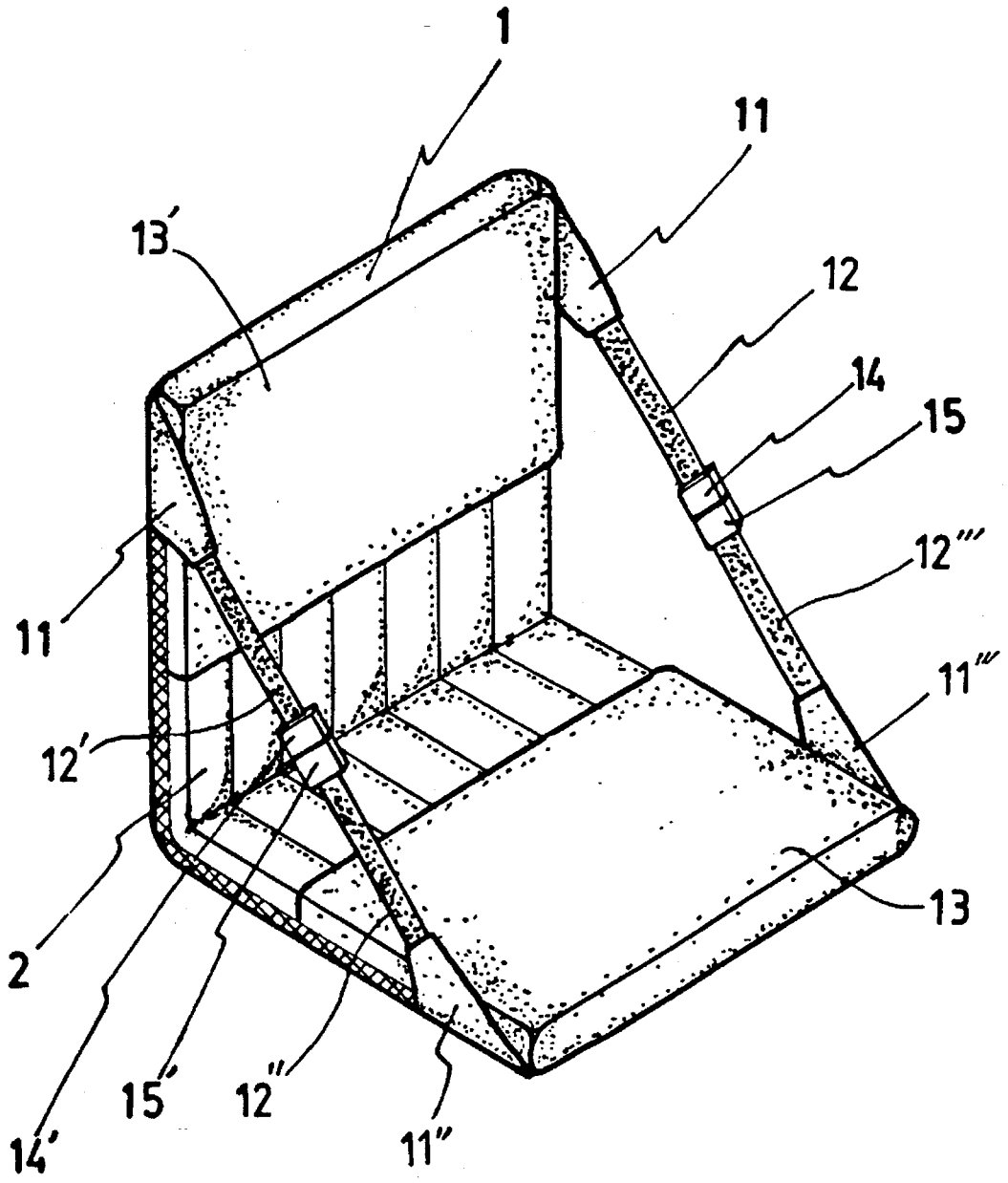
FIG. 3 is an elevational view of the present invention.

Referring to FIGS. 2 and 3, when said air cushion body 2 is set in the seat cover 1, it can be fixed by means of awnings 13, 13' on respective ends, and connection of each two auxiliary support strips 11, 11', 11", 11''' on each side of upper and lower awnings 13, 13', and air cushion body 2 can be joined together with seat cover 1 by means of connection devices 14, 14', 15, 15' in association with connection strips 12, 12', 12", 12''' and auxiliary support strips 11, 11', 11", 11''' , and seat back is adjustable at angle by means of connection strips 12, 12' to make the user feel utmost comfortable.

Therefore, there has been shown and described a novel portable chair which has great improvement for the conventional structure in respect of structure and function; upon discharge of air out of air cushion body, it can be rolled up for saving space and easy for carrying, further the chair with seat back may make user leisure life feel even more comfortable.

We claim:

1. A portable chair structure comprising:

a) a seat cover comprising an elongated portion having opposite ends and an awning formed at both opposite ends, the awnings having openings facing each other wherein the seat cover is formed of a flexible material;

b) a plurality of support rods attached to sides of the seat cover;

c) an air cushion body having a plurality or air cushions and a plurality of air filling and discharge intakes for filling air into and discharging air from the air cushion body, the air cushion body having first and second opposite ends located in the awnings on opposite ends of the seat cover; and, d) strap adjusting means attached to the opposite ends of the seat cover to adjustably position the opposite ends of the seat cover relative to each other.

2. The portable chair of claim 1 wherein the strap adjusting means comprises:

a) first and second connection strips attached to opposite sides of one of the ends of the seat cover;

b) third and fourth connection strips attached to opposite sides of the opposite end of the seat cover; and, c) connection devices attached to the first, second, third and fourth connection strips to releasably connect the connection strips on one end of the seat cover to the connection strips on the opposite end of the seat cover.

* * * * *